US006576842B2

(12) United States Patent
Ishii

(10) Patent No.: US 6,576,842 B2
(45) Date of Patent: Jun. 10, 2003

(54) CONNECTION STRUCTURE OF COATED ELECTRIC WIRE

(75) Inventor: Takashi Ishii, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/842,013

(22) Filed: Apr. 26, 2001

(65) Prior Publication Data

US 2001/0035296 A1 Nov. 1, 2001

(30) Foreign Application Priority Data

May 1, 2000 (JP) ..... 2000-132599

(51) Int. Cl.[7] ..... H01R 4/00
(52) U.S. Cl. ..... 174/84 R; 174/94 R
(58) Field of Search ..... 174/84 R, 84 C, 174/92, 94 R, 72 R, 76, 77 R, 72 C; 29/856, 858; 156/580.2; 439/460

(56) References Cited

U.S. PATENT DOCUMENTS

| | | | | | |
|---|---|---|---|---|---|
| 2,250,156 | A | * | 7/1941 | Ferguson | 174/84 R |
| 3,573,713 | A | * | 4/1971 | Enright et al. | 439/402 |
| 4,431,861 | A | * | 2/1984 | Clabburn et al. | 156/86 |
| 4,470,898 | A | * | 9/1984 | Penneck et al. | 252/511 |
| 4,878,969 | A | * | 11/1989 | Janisch | 156/213 |
| 5,399,810 | A | * | 3/1995 | Hayami | 156/49 |
| 5,584,122 | A | * | 12/1996 | Kato et al. | 174/84 R |
| 5,710,413 | A | * | 1/1998 | King et al. | 153/272.4 |
| 5,869,784 | A | * | 2/1999 | Shinchi | 174/84 R |
| 5,922,993 | A | * | 7/1999 | Ide et al. | 174/84 R |
| 5,925,202 | A | * | 7/1999 | Ide et al. | 156/73.1 |
| 5,929,384 | A | * | 7/1999 | Ide et al. | 174/84 R |
| 5,959,252 | A | * | 9/1999 | Ide et al. | 174/84 R |
| 5,997,340 | A | * | 12/1999 | Ito et al. | 429/460 |
| 6,072,124 | A | * | 6/2000 | Kato et al. | 174/72 C |
| 6,313,407 | B1 | * | 11/2001 | Shinchi et al. | 174/84 R |

FOREIGN PATENT DOCUMENTS

| | | | | |
|---|---|---|---|---|
| EP | 0838883 A2 | | 4/1998 | H01R/43/02 |
| GB | 2321347 | | 7/1998 | H01R/13/52 |
| GB | 2342068 | | 4/2000 | H01R/4/02 |
| GB | 2350732 A | * | 12/2000 | H01R/43/02 |
| GB | 2351396 | | 12/2000 | H01R/4/02 |
| JP | 7-320842 | | 12/1995 | |
| JP | 9-312173 | | 12/1997 | |

* cited by examiner

*Primary Examiner*—Dean A. Reichard
*Assistant Examiner*—William H. Mayo, III
(74) *Attorney, Agent, or Firm*—Finnegan, Henderson, Farabow, Garrett & Dunner, L.L.P.

(57) ABSTRACT

At least two coated electric wires W1 and W2 are superposed. Resin chips 53 and 55 are disposed above and below the superposed connection portion S. These resin chips 53 and 55 have been compressed from above and below and ultrasonic vibration has been applied thereto, thereby melting resin coats 3 in the coated electric wires W1 and W2 to pressure weld conductive wires 1. The resin chips 53 and 55 and the resin coats 3 have been melted and joined to each other, and the resin chips 53 and 55 have also been joined to each other by melting. A pair of resin sealings 4 are provided between the upper resin chip 53 and the coated electric wires W1 and W2 and between the lower resin chip 55 and the coated electric wires W1 and W2. Each resin sealing 4 has rubber elasticity and is formed such as to annularly surround conductive wires 1, which are exposed from the resin coats 3 and pressure welded.

5 Claims, 3 Drawing Sheets

CONNECTION STRUCTURE OF COATED ELECTRIC WIRE

BACKGROUND OF THE INVENTION

1. Field of the Invention

The present invention relates to a connection structure of an electric wire capable of connecting conductive wires of at least two coated electric wires by ultrasonic vibration.

2. Description of the Related Art

There is a known connection structure of electric wire disclosed in Japanese Patent Application Laid-Open No.H7-320842.

As shown in FIG. 1, in this connection structure of electric wire, two conductive wires 1 are coated with resin coating members 3 to form two coated electric wires W1 and W2, and the electric wires W1 and W2 are connected by a predetermined connection portion S in its axial direction, and the connection structure includes a pair of resin chips 53 and 55 for covering the connection portion S from above and below. When the coated electric wires W1 and W2 are connected to each other, a horn 57 for generating ultrasonic vibration and an anvil 59 for supporting the coated electric wires W1, W2 and the resin chips 53, 55 when the wires are connected are used.

The anvil 59 includes a base 61 and a support portion 63, the support portion 63 is formed into a substantially cylindrical shape. The support portion 63 is provided with an inner diameter portion 65 whose upper side (side far from the base) is opened. The opposed peripheral walls 63*a* and 63*b* of the support portion 63 are provided with a pair of grooves 67 and a pair of grooves 69 which are opposed to each other. The four grooves 67 and 69 are opened at the same side as that of the inner diameter portion 65 and formed in a projecting direction of the support portion 63. The opposed grooves 67 and 69 are in communication with each other through the inner diameter portion 65.

Each of the chips 53 and 55 is formed into a circular plate-like shape having an outer diameter slightly smaller than the inner diameter portion 65, and an end surface 71*a* of a head 71 of the horn 57 is a formed cylindrical shape having an outer diameter substantially equal to or slightly smaller than the resin chips 53 and 55.

To connect the two coated electric wires W1 and W2, they are superposed on each other at the connection portion S, the superposed connection portion S is sandwiched between the pair of chips 53 and 55 from above and below. More specifically, the (lower) resin chip 55 is inserted into the inner diameter portion 65 of the anvil 59 such that a welding surface 55*a* is turned upward, and the one coated electric wire W1 is inserted into the opposed groove 67 from above, and the other electric wire W2 is inserted into the other opposed grooves 69 from above, and finally, the other (upper) resin chip 53 is inserted such that a welding surface 53*a* is turned down. The coated electric wires W1 and W2 are disposed such that the connection portions S thereof cross at the central portion of the inner diameter portion 65, and with this arrangement, the connection portions S are sandwiched from above and below in the superposing direction between welding surfaces 53*a* and 55*a* at substantially the center of the upper and lower resin chips 53 and 55.

Next, the resin coats 3 of the connection portions S are scattered and welded by ultrasonic vibration, and the conductive wires (core wires) 1 of the coated electric wires W1 and W2 are pressure welded to each other the connection portion by pressurizing from outside of the resin chips 53 and 55. Thereafter, the pair of resin chips 53 and 55 are welded at the welding surfaces 53*a* and 55*a* to seal the connection portion S.

More specifically, the head 71 of the horn 57 is inserted from above the upper (other) resin chip 53 which was inserted last, the connection portion S is pressurized and vibrated between the horn 57 and the anvil 59 from outside of the upper and lower resin chips 53 and 55. With this operation, the resin coats 3 of the connection portion S are first welded, and the conductive wire 1 in the connection portion S is exposed from the resin coats 3. Then, the conductive wires 1 are pressure welded by compression force from above and below. At that time, the resin coats in the connection portion S and the resin chips 53 and 55 are joined by welding.

If the pressuring and vibrating operations are continued, the resin chips 53 and 55 are welded with the resin coats 3 at the connection portion S, and the welding surfaces 53*a* and 55*a* of the resin chips 53 and 55 are also welded to each other. With this, the conductive wire 1 which was exposed from the resin coats 3 and pressurized is coated with the resin chips 53 and 55.

In the conventional connection structure of the coated electric wires, however, there is a problem that water may enter the pressure welded conductive wires 1 from between the resin chips 53 and 55 and between the resin coats 3 and the resin chips 53 and 55. Thus, the resistance to water is not sufficient.

SUMMARY OF THE INVENTION

The present invention has been accomplished to solve the above problem, and it is an object of the invention to provide a connection structure of coated electric wires capable of reliably preventing water from entering a pressure welded conductive wire.

To achieve the above object, according to a first aspect of the present invention, there is provided a connection structure of a coated electric wire, having at least two coated electric wires which are superposed and resin chips disposed above and below the superposed connection portion of the coated electric wires. The resin chips being compressed from above and below and ultrasonic vibration being applied thereto, thereby melting resin coats in the coated electric wires to pressure weld conductive wires. The resin chips and resin coats are thus melted and thereby all joined together. The connection structure also includes resin sealings, each having rubber elasticity, provided between the upper resin chip and the coated electric wires and between the lower resin chip and the coated electric wires. The sealings may comprise a ferrite.

According to another aspect of the invention, there is provided a connection structure of a coated electric wire having at least two coated electric wires which are superposed and resin chips disposed above and below the superposed portion of the coated electric wires. The resin chips have been compressed from above and below and ultrasonic vibration has been applied thereto, thereby melting resin coats in the coated electric wires to pressure weld the conductive wires. The resin chips and resin coats are thus melted and thereby all joined together.

This aspect also includes resin sealings having rubber elasticity. The sealings annularly surround the perimeter of the connection portion such that exposed and joined conductive wires are within the perimeter. The sealings are placed between the upper resin chip and the coated electric wires and between the lower resin chip and the coated electric wires, and may be a predetermined distance removed from the conductive wires. The sealings may comprise a ferrite and may be inserted into grooves formed in the resin chips.

In the first aspect, if the upper and lower resin chips are pressurized from above and below while applying ultrasonic vibration, the connection portion of the coated electric wires are first compressed. Thus, the resin coats of the connection portion start melting, and the conductive wires exposed from the coated electric wires are pressure welded to each other by the pressure from above and below. At that time, the resin coats of the connection portion and the upper and lower resin chips are melted and joined to each other.

As the resin coats in the connection portion S are melted, the upper and lower resin chips approach each other. Thus, the upper and lower sealings having rubber elasticity approach each other and surround the upper or lower half of the resin coats located at a position separated from the connection portion S by a predetermined distance. The upper and lower sealings receive the ultrasonic vibration so that they are melted and joined to the entire peripheral portions of the resin coats, and melted together with the upper and lower resin chips. Further, the upper and lower sealings are brought into contact with each other in the compressed state and melted and joined to each other. The upper and lower resin chips are also brought into contact with each other and melted and joined to each other.

By compressing the upper and lower resin chips with the horn and the anvil until the resin chips are joined to each other, the conductive wires exposed from the resin coats in the connection portion S are strongly pressure welded. Thus, the conductive wires in the connection portion S are reliably and electrically connected to each other. Further, in the periphery of the connection portion S, the upper and lower sealings surround the peripheral surfaces of the resin coats from above and below, and the sealings and the entire peripheral portions of the resin coats are melted and joined together. The upper and lower sealings are also melted and joined together to the upper and lower resin chips. The upper and lower resin chips that are in contact with each other are also melted and joined together. Therefore, even if water entered between the joined surfaces of the upper and lower resin chips or between the resin coats and the resin chips, the water can reliably be blocked at the positions of the sealings. Thus, it is possible to reliably prevent water from reaching the pressure welded conductive wires.

In the "ferrite" aspect, since the ferrite functions as a cross-linking agent, the sealings exhibit great rubber elasticity. Further, the ferrite strengthens the junctions between the upper and lower sealings, between the sealings and the resin coats, and between the sealings and the resin chips. Thus, it is possible to maintain the resistance to water even though they are used for a long term.

In another aspect, if the upper and lower resin chips are pressurized while applying the ultrasonic vibration from above and below, the resin coats in the connection portion start melting and the conductive wires exposed from the resin coats are pressure welded by the pressure from above and below. At that time, the resin coats and the upper and lower resin chips at the connection portion are also melted and joined. As the resin coats in the connection portion are melted, the upper and lower resin chips approach each other. Thus, the upper and lower sealings having rubber elasticity approach each other such as to surround the upper or lower half of the resin coats. Further, since the upper and lower sealings receive the ultrasonic vibration, they are melted and joined to the entire peripheral portions of the resin coats and to the upper and lower resin chips. Further, the upper and lower sealings are brought into contact with each other in the compressed state, and melted and joined to each other. The upper and lower resin chips are also brought into contact with each other and melted and joined to each other.

By compressing the upper and lower resin chips with the horn and the anvil until the resin chips are joined to each other, the conductive wires exposed from the resin coats in the connection portion are strongly pressure welded. Thus, the conductive wires in the connection portion are reliably and electrically connected to each other.

Further, in the periphery of the connection portion, the upper and lower sealings surround the peripheral surfaces of the resin coats from above and below, and the sealings and the entire peripheral portions of the resin coats are melted and joined together. The upper and lower sealings are also melted and joined together, and the upper and lower sealings are melted and joined to the upper and lower resin chips. The upper and lower resin chips are also melted and joined together. Therefore, even if water entered between the joined surfaces of the upper and lower resin chip or between the resin coats and the resin chips, the water can reliably be blocked at the positions of the sealings. Thus, it is possible to reliably prevent water from reaching the pressure welded conductive wires.

In the above aspect, since the ferrite functions as a cross-link agent, the sealings exhibit rubber elasticity. Further, the ferrite strengthens the junction between the upper and lower sealings, between the sealings and the resin coats, and between the sealings and the resin chips. Thus, it is possible to maintain the resistance to water even though they are used for a long term.

In another aspect, the resin chips are formed with the grooves into which the sealings are inserted, thus the positions of the sealings with respect to the resin chips are constant. Therefore, the assembly operation becomes easy, and it is possible to provide a structure having constant resistance to water without variation.

DESCRIPTION OF THE PREFERRED EMBODIMENT

An embodiment of the present invention will be explained with reference to FIGS. 2 to 4. The same constituent elements as those of the conventional example are designated with the same symbols, and explanation thereof is simplified.

Figure 1:
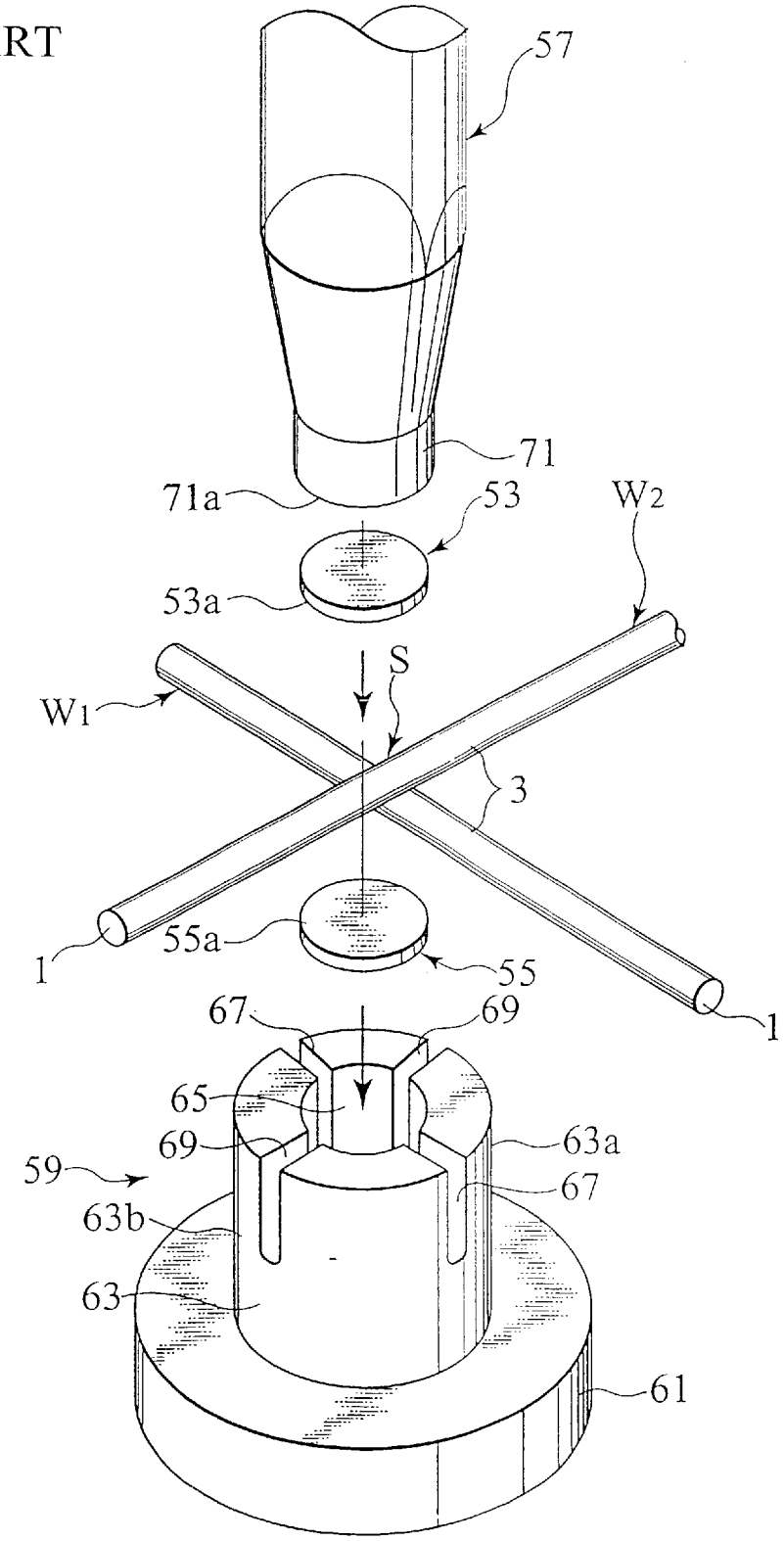
FIG. 1 PRIOR ART
FIG. 1 is an exploded perspective view of a conventional connection structure of coated electric wires.
Figure 2:
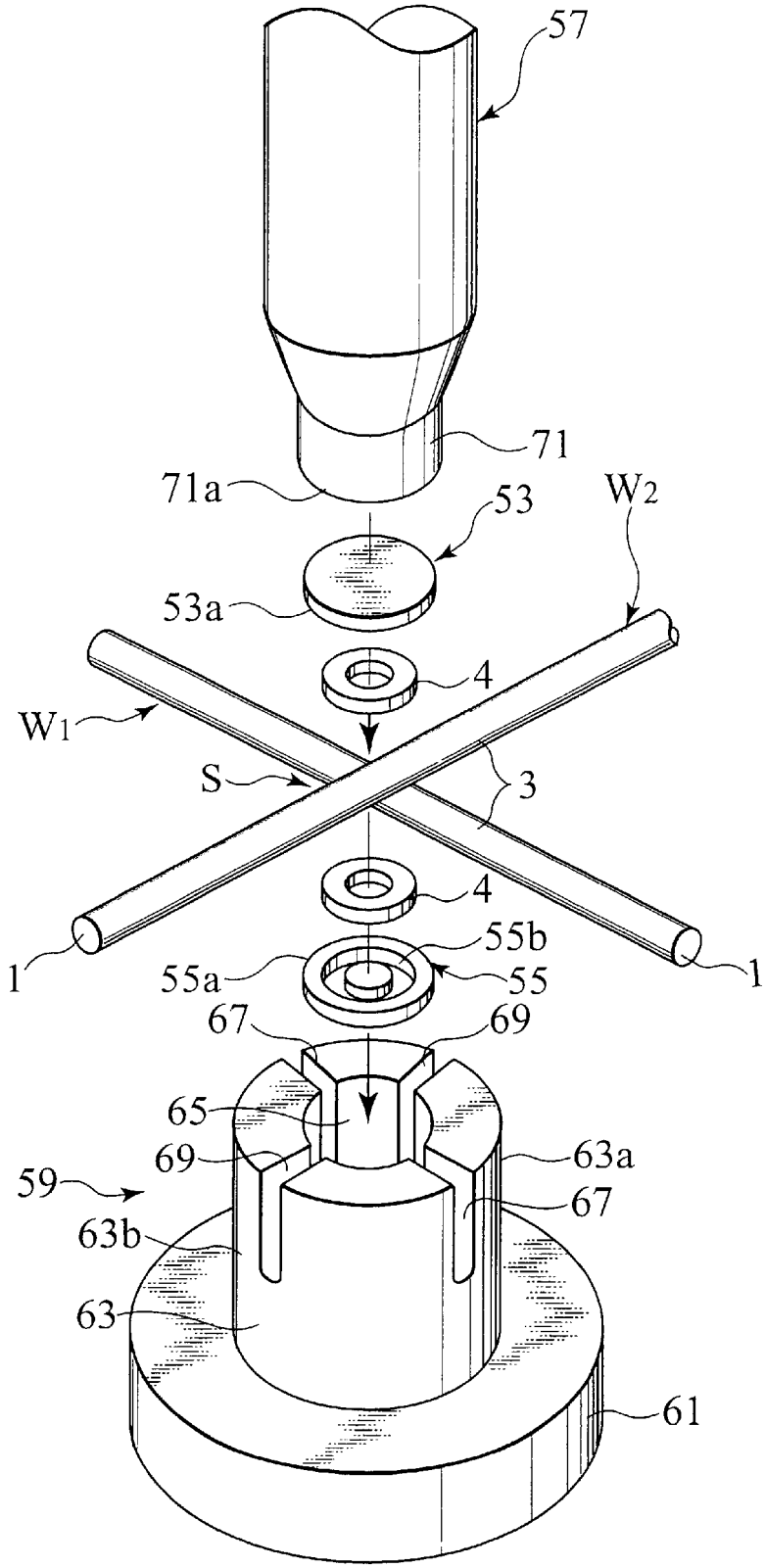
FIG. 2 is exploded perspective view of a connection structure of coated electric wires according to an embodiment of the present invention.
Figure 3:
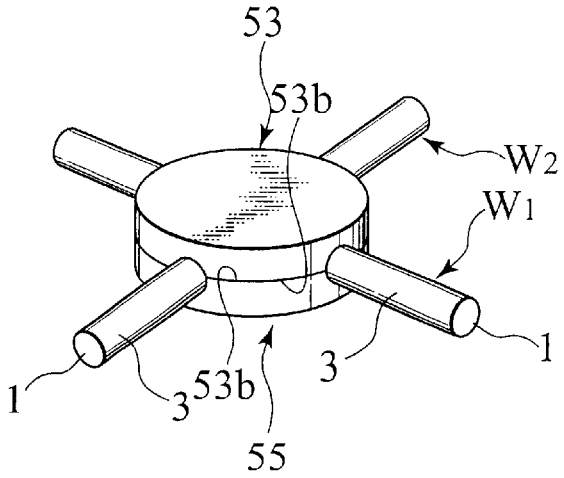
FIG. 3 is a perspective view of outward appearance of the connection structure of the coated electric wires.
Figure 4:
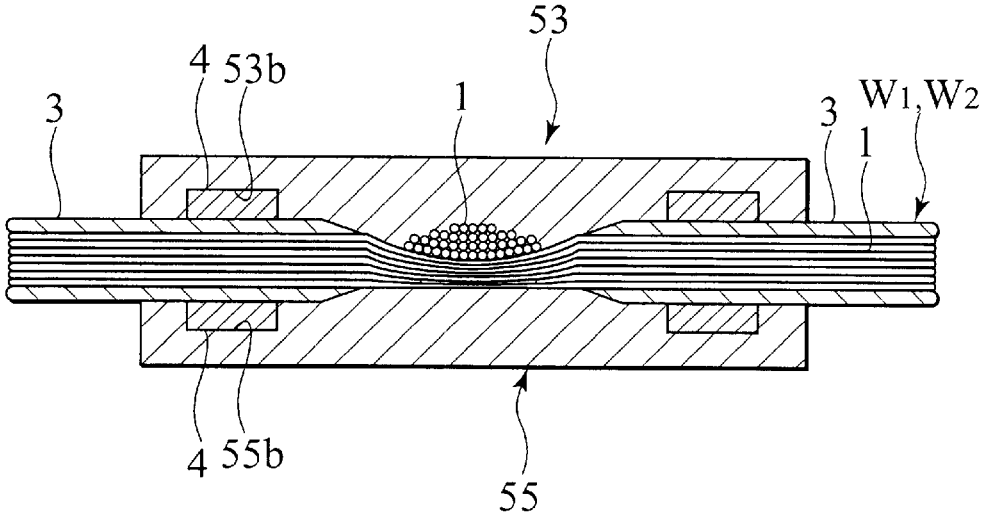
FIG. 4 is a sectional view of the connection structure of the coated electric wires.

As shown in FIGS. 2 to 4, according to a connection structure of coated electric wires of this embodiment, two coated electric wires W1 and W2 are superposed and resin chips 53 and 55 are disposed on the superposed connection portion S from above and below. The resin chips 53 and 55 are compressed from above and below and are subjected to ultrasonic vibration so that resin coats 3 in the coated electric wires W1 and W2 are welded to the conductive wires 1. The resin chips 53 and 55 and the resin coats 3 are all welded and joined to each other. Annular resin sealings 4 having rubber elasticity are provided between the upper resin chip 53 and the coated electric wires W1 and W2 and between the lower resin chip 55 and the coated electric wires W1 and W2 such as to surround the conductive wires 1 which are pressure welded.

The sealings 4 include ferrite, and the ferrite functions as a cross-linking agent for welding and joining the resin chips 53 and 55 and the resin coats 3. The resin chips 53 and 55 are respectively formed at their welding surfaces 53*a* and 55*a* with grooves 53*b* and 55*b* into which the sealings 4 are inserted.

The horn 57 for compressing while applying ultrasonic vibration, and the anvil 59 for supporting the coated electric wires W1 and W2 and the resin chips 53 and 55 are as described in the description of related art.

The structure will be explained in more detail. That is, each of the sealings 4 is formed into a circle annular shape using normal rubber or resin having rubber elasticity such as thermoplastic elastomer including ferrite as a cross-linking agent. A cross section of the sealing 4 is square. The thermoplastic elastomer exhibits rubber elasticity at room temperature, but it is plasticized at a high temperature. Therefore, the thermoplastic elastomer can be injection molded and extruded like the thermoplastic resin. When thermoplastic elastomer is used, it is possible to mass produce the sealings 4. Examples of the thermoplastic elastomer are olefin-based elastomer, styrene-based elastomer, amide-based elastomer, urethane-based elastomer, vinyl chloride-based elastomer and the like.

The resin chips 53 and 55 are injection molded into the same disc-like shape using the thermoplastic resin such as PBT (polybutylene terephthalate) and PEI (polyether imide). The grooves 53*b* and 55*b* are formed into cylindrical shapes concentrically with the axes of the resin chips 53 and 55. Cross sections of the grooves 53*b* and 55*b* are formed into the cross section shape of the sealing 4, such as square shapes. The sealings 4 are fitted into the grooves 53*b* and 55*b*. The grooves 53*b* and 55*b* have such depths that the sealing 4 project from the welding surfaces 53*a* and 55*a* by predetermined amounts. Alternatively, the depths of the grooves 53*b* and 55*b* may be set such that the sealings 4 are flush with the welding surfaces 53*a* and 55*a*. The resin coats 3 of the coated electric wires W1 and W2 are made of thermoplastic resin such as PVC (vinyl chloride).

In the connection structure of the coated electric wires having the above structure, first, the sealings 4 are fitted to the grooves 53*b* and 55*b* of the resin chips 53 and 55. The lower resin chip 55 is inserted into a support portion 63 with the sealing 4 facing horn 57. Then, a coated electric wire W1 is inserted into grooves 67, and another coated electric wire W2 is inserted into grooves 69. The upper resin chip 53 is inserted into the support portion 63 such that the sealing 4 faces away from horn 57.

Thereafter, the head 71 of the horn 57 is inserted into the support portion 63, and the upper surface of the resin chip 53 is compressed while applying ultrasonic vibration. With this operation, the coated electric wires W1 and W2, the sealings 4 and the resin chips 53 and 55 are compressed between the horn 57 and the anvil 59 while receiving the ultrasonic vibration.

At that time, in the connection portion S at which the coated electric wires W1 and W2 are superposed, the resin coats 3, as well as the resin chips 53 and 55 are compressed under a great force. Therefore, the resin coats 3 in the connection portion S start melting, the conductive wires 1 exposed from the resin coats 3 are pressure welded by the pressure from above and below. At that time, the resin coats 3 and the upper and lower resin chips 53 and 55 at the connection portion S are also melted and joined.

As the resin coats 3 and the like in the connection portion S are melted, the upper and lower resin chips 53 and 55 approach each other. Thus, the upper and lower sealings 4 having rubber elasticity approach each other such as to surround the upper or lower half of resin coats 3 located at position separated from the connection portion S by a predetermined distance. The upper and lower sealings 4 receive the ultrasonic vibration so that they are melted and joined to the entire peripheral portions of the resin coats 3, and melted together with the upper and lower resin chips 53 and 55. Further, the upper and lower sealings 4 are brought into contact with each other in the compressed state, and melted and joined to each other. The upper and lower resin chips 53 and 55 are also brought into contact with each other, and melted and joined to each other.

By compressing the upper and lower resin chips 53 and 55 by the horn 57 and anvil 59 until the resin chips 53 and 55 are joined to each other, the conductive wires 1, exposed from the resin coats 3 in the connection portion S, are pressure welded. Thus, the conductive wires 1 in the connection portion S are electrically connected to each other.

Further, in the periphery of the connection portion S, the upper and lower sealings 4 surround the peripheral surfaces of the resin coats 3 from above and below. The sealings 4 and the entire peripheral portions of the resin coats 3 are melted and joined together while the upper and lower sealings 4 are also melted and joined together, the upper and lower sealings 4 are also melted and joined to upper and lower resin chips 53 and 55. The upper and lower resin chips 53 and 55 are also melted and joined together. Therefore, even if water entered between the joined surfaces of the upper and lower resin chips 53 and 55 or between the resin coats 3 and the resin chips 53 and 55, the water can reliably be blocked at the positions of the sealings 4. Thus, it is possible to reliably prevent water from the pressure welded conductive wires 1.

Further, since the ferrite functions as a cross-linking agent, the sealings 4 exhibit rubber elasticity. The ferrite strengthens the junctions, between the upper and lower sealings 4, between the sealings 4 and the resin coats 3, and between the sealings 4 and the resin chips 53 and 55. Thus, it is possible to maintain the resistance to water even though they are used for a long term.

Further, since the resin chips 53 and 55 are formed with the grooves 53*b* and 55*b* into which the sealings 4 are inserted, the positions of the sealings 4 with respect to the resin chips 53 and 55 are constant. Therefore, the assembly operation becomes easy, and it is possible to provide a structure having constant resistance to water without variation.

Even when the sealings 4 are inserted into the grooves 53*b* and 55*b* such that the sealings 4 and the welding surfaces 53*a* and 55*a* are flush with each other, if the upper and lower resin chips 53 and 55 abut, the upper and lower sealings 4 surround the resin coats 3 from above and below. Therefore, the upper and lower sealings 4 are melted together with the entire peripheral portions of the resin coats 3.

Although the support portion 63 of the anvil 59 is provided with the two pair of grooves 67 and 69, another pair of grooves may be formed, and three or more coated electric wires may be held and connected.

What is claimed is:

1. A connection structure of a coated electric wire, comprising:

at least two electric conductive wires coated with a resin coating forming at least two coated wires, the wires being superposed;

upper and lower resin chips disposed above and below, respectively, a superposed connection portion of the coated electric wires, in which the resin chips have been compressed from above and below and ultrasonic vibration has been applied thereto, thereby melting the resin coatings of the electric conductive wires to pressure weld the electric conductive wires;

the upper and lower resin chips and the resin coats melted and joined to each other; and at least two resin sealings each having rubber elasticity, a first of said resin sealings located between the upper resin chip and the coated electric wires and a second of the said resin sealings located between the lower resin chip and the coated electric wires; wherein the at least two resin sealings and upper and lower resin chips encapsulate the superposed connection portion of the coated electric wires after the upper and lower resin chips and the resin coats have been melted and joined to each other.

2. The connection structure of a coated electric wire of claim 1, wherein each of the sealings comprises ferrite.

3. A connection structure of a coated electric wire, comprising:

at least two electric conductive wires coated with a resin coating forming at least two coated wires, the coated wires being superposed;

upper and lower resin chips disposed above and below, respectively, a superposed connection portion of the coated electric wires, in which the resin chips have been compressed from above and below and ultrasonic vibration has been applied thereto, thereby melting the resin coatings of the electric conductive wires to pressure weld the electric conductive wires;

the upper and lower resin chips and the resin coats melted and joined to each other; and at least two resin sealings formed so as to annularly surround the electric conductive wires at a predetermined distance from the superposed connection portion of the coated electric wires, the resin sealings each having rubber elasticity, a first of said resin sealings located between the upper resin chip and the coated electric wires and a second of the said resin sealings located between the lower resin chip and the coated electric wires; wherein the at least two resin sealings and upper and lower resin chips encapsulate the superposed connection portion of the coated electric wires after the upper and lower resin chips and the resin coats have been melted and joined to each other.

4. The connection structure of a coated electric wire of claim 3, wherein each sealings comprises ferrite.

5. The connection structure of a coated electric wire of claim 3, wherein each of the resin chips has a groove into which the sealing is to be inserted.

* * * * *

UNITED STATES PATENT AND TRADEMARK OFFICE

CERTIFICATE OF CORRECTION

PATENT NO. : 6,576,842 B2
DATED : June 10, 2003
INVENTOR(S) : Takashi Ishii

It is certified that error appears in the above-identified patent and that said Letters Patent is hereby corrected as shown below:

Column 7,
Line 7, “the wires” should read -- the coated wires --.

Column 8,
Line 27, “each sealings” should read -- each of the sealings --.

Signed and Sealed this

Twenty-seventh Day of January, 2004

JON W. DUDAS
*Acting Director of the United States Patent and Trademark Office*